US009955739B2

(12) United States Patent
Melarti et al.

(10) Patent No.: US 9,955,739 B2
(45) Date of Patent: May 1, 2018

(54) BODY SHAPING GARMENT

(71) Applicant: Blanqi, LLC, Duluth, GA (US)

(72) Inventors: Sabina Melarti, Duluth, GA (US); Valerie Caron, Fort Mill, SC (US)

(73) Assignee: Blanqi, LLC, Atlanta, GA (US)

( * ) Notice: Subject to any disclaimer, the term of this patent is extended or adjusted under 35 U.S.C. 154(b) by 418 days.

(21) Appl. No.: 14/593,672

(22) Filed: Jan. 9, 2015

(65) Prior Publication Data

US 2015/0196064 A1 Jul. 16, 2015

Related U.S. Application Data

(60) Provisional application No. 61/925,888, filed on Jan. 10, 2014.

(51) Int. Cl.

| | |
|---|---|
| ***A41C 1/12*** | (2006.01) |
| ***A41B 9/04*** | (2006.01) |
| ***A41C 1/08*** | (2006.01) |
| *A41B 9/10* | (2006.01) |
| *A41D 1/22* | (2018.01) |

(52) U.S. Cl.

CPC ..... *A41C 1/12* (2013.01); *A41B 9/04* (2013.01); *A41C 1/08* (2013.01); *A41B 9/10* (2013.01); *A41B 2400/38* (2013.01); *A41B 2400/82* (2013.01); *A41D 1/22* (2013.01)

(58) Field of Classification Search

CPC ..... A41C 1/00; A41C 1/003; A41C 1/08
USPC ..... 2/69, 74, 212, 220, 221, 227, 228, 238, 2/409; 450/94–96, 7, 8, 18, 20, 28, 450/30–33

See application file for complete search history.

(56) References Cited

U.S. PATENT DOCUMENTS

| | | | | | |
|---|---|---|---|---|---|
| 1,979,540 | A | * | 11/1934 | Gershen | A41B 9/08 450/11 |
| 3,678,514 | A | * | 7/1972 | Safrit | A41B 9/08 2/212 |
| 4,789,372 | A | | 12/1988 | Wicks | |
| 5,094,648 | A | | 3/1992 | Turner | |
| 5,649,328 | A | * | 7/1997 | Martin | A41D 1/08 2/227 |
| 5,702,286 | A | | 12/1997 | Seering et al. | |
| 5,915,531 | A | | 6/1999 | Hilpert et al. | |
| 5,916,531 | A | | 6/1999 | Pan | |
| 5,928,059 | A | | 7/1999 | Wicks | |
| 6,155,906 | A | | 12/2000 | May | |
| 6,186,861 | B1 | | 2/2001 | Flaherty | |
| 6,517,409 | B2 | | 2/2003 | Flaherty | |
| 6,817,034 | B2 | | 11/2004 | Smilovic | |

(Continued)

OTHER PUBLICATIONS

Spanx® by Sara Blakely® Three (3) Spanx Maternity Garments entitled "Power Mama, Mama Full Length; and Mama Footless," http://www.spanx.com/search/index.jsp?kw=maternity, downloaded on Jul. 6, 2009.

*Primary Examiner* — Gloria Hale
(74) *Attorney, Agent, or Firm* — Lerner, David, Littenberg, Krumholz & Mentlik, LLP

(57) ABSTRACT

A garment or undergarment includes an inner part and an outer part. The inner part has an upper portion for covering and compressing at least a portion of a mid-section of a wearer above a waistline of a wearer and a lower portion for covering a groin of a wearer and limiting upward movement of the inner part. The outer part is attached to the inner part and overlaps at least a portion of the lower portion.

13 Claims, 3 Drawing Sheets

(56) References Cited

U.S. PATENT DOCUMENTS

| | | | | |
|---|---|---|---|---|
| 7,008,292 | B2 | 3/2006 | Cosentino et al. | |
| 7,181,775 | B2 | 2/2007 | Carney | |
| 7,260,961 | B1 | 8/2007 | Kennedy | |
| 7,395,557 | B1 | 7/2008 | Ledyard | |
| 7,441,418 | B2 | 10/2008 | Delgado-Mecinas | |
| 7,546,751 | B2 | 6/2009 | Lutz | |
| 7,676,852 | B1 | 3/2010 | Carney | |
| 8,191,177 | B1 | 6/2012 | Carney | |
| 8,235,766 | B2 | 8/2012 | Melarti et al. | |
| 8,256,027 | B2 | 9/2012 | Pedersen et al. | |
| 8,276,216 | B2 | 10/2012 | Carney | |
| 8,568,195 | B1 | 10/2013 | Schindler | |
| 8,864,551 | B2 | 10/2014 | Melarti et al. | |
| 9,314,053 | B2 | 4/2016 | Melarti et al. | |
| 2007/0249265 | A1 | 10/2007 | Delgado-Mecinas | |
| 2008/0244805 | A1* | 10/2008 | Griffin | A41C 1/00 2/74 |
| 2009/0081926 | A1 | 3/2009 | Gros | |
| 2009/0083894 | A1* | 4/2009 | Causey-Gabbe | A41B 9/08 2/78.1 |
| 2009/0098801 | A1 | 4/2009 | Pedersen et al. | |
| 2009/0270012 | A1 | 10/2009 | Melarti et al. | |
| 2010/0299797 | A1* | 12/2010 | Riehl | A41D 1/22 2/67 |
| 2012/0129425 | A1* | 5/2012 | Bevans | A41D 1/06 450/11 |
| 2012/0302133 | A1 | 11/2012 | Melarti et al. | |
| 2013/0095730 | A1* | 4/2013 | Jensen | A41C 1/003 450/95 |
| 2015/0038050 | A1 | 2/2015 | Melarti et al. | |

* cited by examiner

BODY SHAPING GARMENT

CROSS-REFERENCE TO RELATED APPLICATION

The present application claims the benefit of the filing date of U.S. Provisional Patent Application No. 61/925,888, filed Jan. 10, 2014, the disclosure of which is hereby incorporated herein by reference.

FIELD OF THE TECHNOLOGY

The present disclosure relates to garments that provide support and shaping for the body of a wearer and that provide less friction to allow less restriction and promote more flowability of outer garments relative to conventional undergarments and direct skin contact.

BACKGROUND OF THE TECHNOLOGY

The human population today is more diverse than ever. People vary greatly in height and in build. Despite the variation in the population, it is desirable for many people, especially women, to have a thin, athletic appearance.

Achieving such a look sometimes has undesirable consequences. Slips have often been used as additional undergarments overlying a wearer's underwear to prevent the underwear from showing through clothing or to prevent a silhouette of a wearer's legs from showing through clothing. By separating outer garments from the body, slips also reduce the friction with outer garments that would otherwise be produced.

Slips generally fall into two categories, (i) full-length slips that extend from the shoulders by straps down to at least the upper thigh and (ii) what are often called "half-slips" which extend from the waist, generally by means of an elastic waistband. Additionally, pettipants are a variation of half slips which have a central section that wraps underneath the groin area to prevent the pettipants from "riding up," i.e., moving in the superior direction of a body.

Full-length and half slips rely on gravity to prevent riding up although some of these slips, especially half slips, include a thin elastic waistband placed about a waistline of a wearer. Although these types of waistbands may provide some resistance to upward movement of the slip, such configurations create a bulky and often undesirable impression at a wearer's waistline.

Half slips and pettipants also rely on an elastic waistband to prevent shifting in an inferior direction and, moreover, do not provide coverage of the body above the natural waistline.

As an alternative to slips and in some cases underwear, some outer garments, such as tennis skirts, include integral liners made with compressible materials that conform to wearer's body. However, such outer garments do not extend above a wearer's natural waistline and thus do not provide adequate body shaping.

Accordingly, there exists a need for a garment that further enhances body shaping and smoothing and better maintains consistent positioning on a wearer's body.

BRIEF SUMMARY OF THE TECHNOLOGY

In one aspect of the technology, a garment, which may be an outer garment or an undergarment, may include an inner part and an outer part. The inner part may have an upper portion for covering and compressing at least a portion of a mid-section, such as the belly, of a wearer. The upper portion preferably may extend at least 75 mm and more preferably at least 150 mm above a waistline of a wearer, although the upper portion may extend distances less than 75 mm, and even less than 25 mm, above a waistline of a wearer as well. The inner part may include a lower portion that may have a central section for covering a groin of a wearer. In some arrangements, the central section may limit upwardly directed, i.e., superiorly directed, motion of the inner part. The outer part of such a garment may be attached to and overlap at least a portion of the lower portion of the inner part.

In another aspect of the technology, a garment, which may be an outer garment or undergarment, may include an upper part and a lower part. The upper part may have an upper portion for covering and compressing at least a portion of a mid-section of a wearer. The upper part preferably may extend at least 75 mm and more preferably at least 150 mm above a waistline of a wearer, although the upper part may extend distances less than 75 mm, and even less than 25 mm, above a waistline of a wearer as well. The lower part may include a central section for covering a groin of a wearer. In some arrangements, the central section may limit upwardly directed motion of the lower part. In some arrangements, the lower part may be in the form of shorts or pettipants. In some arrangements, the lower part may have a smooth outer surface that may provide less friction against outer garments as compared to direct contact between such outer garments and other undergarments or a wearer's skin.

In another aspect of the technology, a garment may include an inner part and an outer part. The inner part may have an upper portion and a lower portion. The upper portion may cover and may compress at least a portion of a mid-section of a wearer above a waistline of the wearer. The lower portion may cover a groin of the wearer to limit movement of the inner part in a superior direction. The outer part may be attached to the inner part and may overlap the lower portion of the inner part.

In some arrangements, the lower portion of the inner part may be in the form of panties or a thong. In some arrangements, the lower portion of the inner part may be in the form of shorts. In some arrangements, the lower portion of the inner part may be in the form of pettipants.

In some arrangements, the outer part may be pleated. In some arrangements, the upper and lower portions of the outer part may be defined within a single piece of material such that there may be a visibly seamless transition between the upper and the lower portions at least 12 mm at least one of above and below the waistline. In some arrangements, the upper and lower portions of the outer part may be sewn together to form a seam at the waistline. In some arrangements, the outer part may be attached to the inner part at the waistline of the wearer.

In some arrangements, an entire length of the inner part may extend from the waistline in a superior direction to an upper peripheral edge of the garment. In some such arrangements, the upper peripheral edge may be positionable beneath and adjacent to the bust of the wearer. In other such arrangements, the inner part may be arranged to cover the bust of the wearer.

In some arrangements, the garment may further include at least one strap. In some such arrangements, the strap may be attachable to front and back portions of the inner part and may be extendable around the shoulders of the wearer and between the front and back portions of the garment. In other such arrangements, the strap may be extendable around the neck of the wearer and may be attachable at two or more spaced-apart locations on the front portion of the garment.

In some arrangements, the outer part may be in the form of an A-line design.

In some arrangements, the entirety of the garment may be underwear. In other arrangements, the outer part of the garment may be outerwear while the upper and lower portions of the garment are underwear. In some arrangements in which the outer part is outerwear, the upper portion of the garment may be outerwear as well. In some arrangements, only the upper portion may be outerwear while the lower portion and the outer part of the garment are underwear.

In another aspect of the technology, a garment may include an upper part and a lower part. The upper part may cover and may compress at least a portion of a mid-section of a wearer above the waistline of the wearer. The lower part may be attached to the upper part at an interface region. The lower part may cover a groin of the wearer to limit movement of the lower part in a superior direction. The upper part may provide a compression against the mid-section of the wearer sufficient to maintain the position of the garment or undergarment without support from the lower part.

In some arrangements, the lower part may be in the form of panties or a thong. In some arrangements, the lower part may be in the form of shorts. In some arrangements, the lower part may be in the form of pettipants.

In some arrangements, the upper and the lower parts may be defined within a single piece of material such that there may be a visibly seamless transition between the upper and the lower parts at least 12 mm at least one of above and below the waistline.

In some arrangements, the upper and the lower parts may be sewn together to define a seam at the waistline. In some arrangements, the outer part may be attached to the inner part at the waistline of the wearer.

In some arrangements, an entire length of the inner part may extend from the waistline in a superior direction to an upper peripheral edge of the garment. In some such arrangements, the upper peripheral edge may be positionable beneath and adjacent to the bust of the wearer. In other such arrangements, the inner part may be arranged to cover the bust of the wearer.

In some arrangements, the entirety of the garment may be underwear. In other arrangements, the lower part of the garment may be outerwear while the upper part is underwear. In some arrangements in which the lower part is outerwear, the upper part of the garment may be outerwear as well. In some arrangements, only the upper part may be outerwear while the lower part is underwear.

BRIEF DESCRIPTION OF THE DRAWINGS

These and other features, aspects, and advantages of the present disclosure will become better understood with regard to the following description viewed in conjunction with the accompanying drawings, in which like reference numerals in the drawings designate like structure unless otherwise stated and in which.

DETAILED DESCRIPTION

As used herein, the term "superior" describes a location closer to the head of a wearer and the term "inferior" describes a location closer to the feet of a wearer. Likewise, as also used herein, the phrase "superior direction" describes a direction towards the head of the wearer and the phrase "inferior direction" describes a direction towards the feet of the wearer.

Figure 1B:
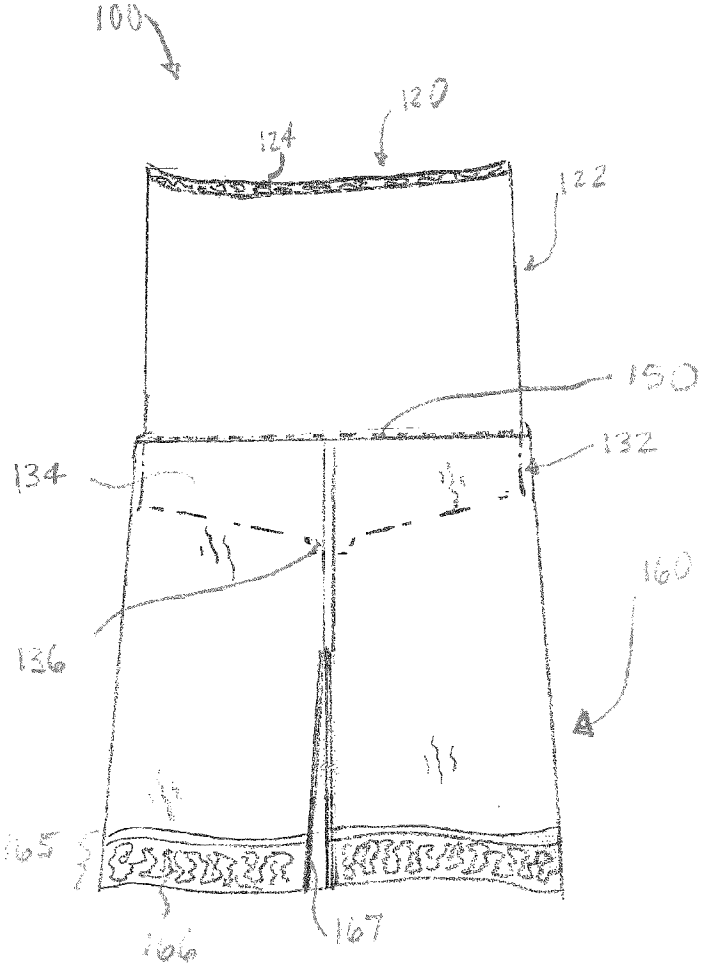
FIGS. 1A and 1B are front and rear views, respectively, of a garment in accordance with an embodiment, the broken lines representing a portion of the garment visible upon removal of an outer part.
Figure 1A:
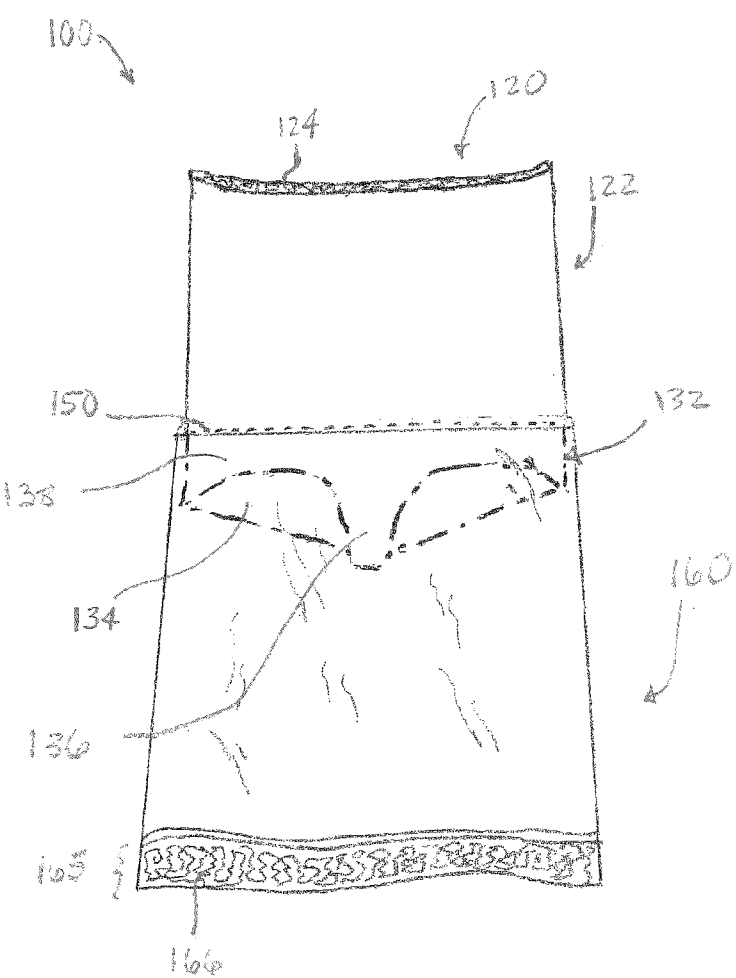

Referring now to FIGS. 1A and 1B, garment 100, which may be a slip or skirt, may include inner part 120 and outer part 160. As shown, garment 100 may be used as an undergarment of a wearer beneath outer garments that would be visible to others or as an outergarment, depending on the type of materials used. Overall, the two-part configuration of garment 100 provides smoothing and shaping to a silhouette of the body of a wearer while also providing less friction against outer garments as compared to direct contact between such outer garments and other undergarments or a wearer's skin. In this configuration, garment 100 remains substantially in the same location when worn by the wearer while at the same time allowing outer garments that may be worn over garment 100 to move freely relative to the wearer's body.

Inner part 120 may include upper portion 122 which extends from interface region 150 in the superior direction, such region being defined by the portions of attachment between inner part 120 and outer part 160, e.g., the portions of inner part 120 and outer part 160 overlapped or underlapped by a stitch maintaining a connection between inner part 120 and outer part 160, and lower portion 132 which extends from interface 150 in the inferior direction. When garment 100 is worn by a wearer, interface 150 may be positioned one of substantially at, above, or below a wearer's natural waistline.

Considered in isolation from outer part 160, inner part 120 may be seamless, mostly seamless as shown, or at least partially seamless. When partially seamless, inner part 120 preferably may be seamless at least 12 mm, or more preferably at least 50 mm, or even more preferably at least 75 mm at least one of above and below the waistline. In a seamless configuration, or in a mostly seamless configuration as shown, inner part 120 may be made of a knitted fabric or other stretchable material. In this manner, inner part 120 may be form-fitted to the body of a wearer and accordingly exert compression against the body of the wearer to allow inner part 120 to remain at substantially the same location on the body of the wearer during use.

As in the example of FIGS. 1A and 1B, upper portion 122 of the inner part 120 may include sufficient material to cover a wearer's belly to a position in the superior direction just below the bust of a wearer. Lower portion 132 of inner part 120 may be shaped in a panty-like configuration. In this manner, lower portion 132 may include rear section 134 providing coverage over at least a portion of a wearer's buttocks and may include central section 136 that extends from rear section 134 and wraps underneath a groin area of a wearer to front section 138 of lower portion 132. In this manner, central section 136 may prevent garment 100 from riding up relative to the body of the wearer. As shown, rear section 134 may extend further in the inferior direction than front section 138 of lower portion 132. Such a configuration may provide more comfort to a wearer by relieving stress on the top of a wearer's hips as well as to provide what is generally considered a more intimate look.

Inner part 120 may include additional aesthetic features. For example, as shown in FIGS. 1A and 1B, upper portion 122 of inner part 120 may include border 124, which may be a sewn-in lace region, at, and in the example shown along, an inferior edge of inner part 120.

As further shown in the example of FIGS. 1A and 1B, outer part 160 of garment 100 may be, but is not limited to being, a slip or skirt that may provide a cover for inner part 120. In the form of a skirt, outer part 160 may be used as activewear for casual lounging.

Outer part 160 is attached at interface region 150, as previously described herein, and further extends downwardly in the inferior direction so as to cover at least a portion of lower portion 132 of inner part 120. In a preferred arrangement, such as in the example of the FIGS. 1A and 1B, outer part 160 may completely cover lower portion 132. In some arrangements, as in the example shown, outer part 160 may extend a length to cover a majority of the legs of a wearer. In this manner, outer part 160 may produce lower friction when sliding against longer outer garments, such as dresses, along a wearer's legs in comparison to direct skin contact or contact with other types of undergarments.

Outer part 160 may include additional aesthetic features. For example, as shown in FIGS. 1A and 1B, lower edge 165 of outer part 160 may include border 166, which may be a sewn-in lace region. Outer part 160 may include slit 167 extending from below central section 136 and through lower edge 165 of outer part 160. In addition to providing aesthetic variation, slit 167 may also act to provide stress relief to outer part 160 during movement of a wearer's legs.

Figure 2B:
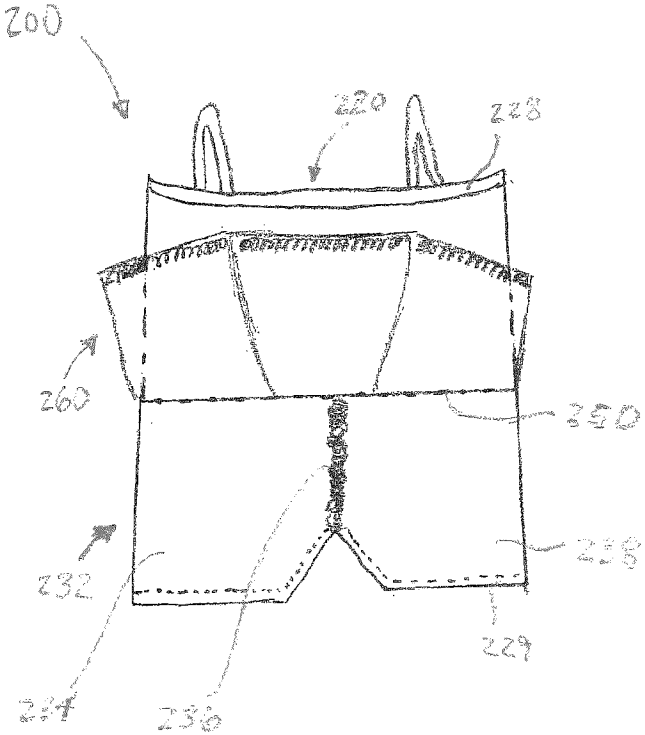
FIGS. 2A and 2B are front and rear views, respectively, of a garment in accordance with another embodiment, the broken lines representing a portion of the garment visible upon removal of an outer part.
Figure 2A:
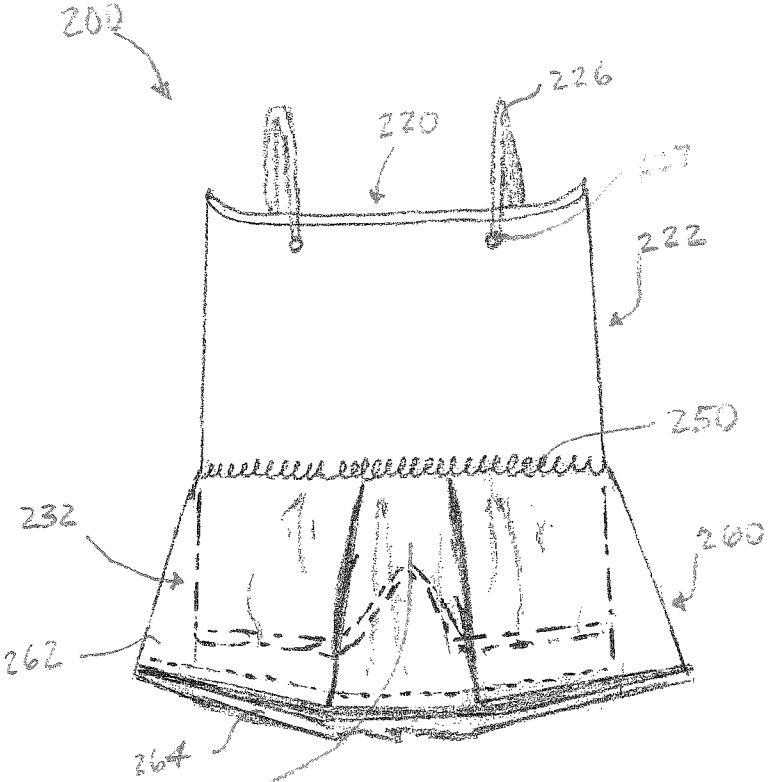

Turning now to FIGS. 2A and 2B, in an alternative arrangement, garment 200 may include inner part 220 and outer part 260 that may be attached to inner part 220 at interface region 250. As shown, a majority of inner part 220 may be substantially similar to inner part 120 including at interface region 250 with certain notable exceptions.

In this example, in contrast to inner part 120 of garment 100, inner part 220 may include upper portion 222 having straps 226 adjacent to top edge 228, i.e., the most superior end thereof. As shown, straps 226 may attach to both front and rear sides of inner part 220 such that straps 226 may wrap around the shoulders of a wearer. In this manner, in combination with compression provided by upper portion 222 against the body of a wearer, straps 226 may prevent garment 200 from falling in the inferior direction, for example, due to walking or other movements by the wearer. As further shown, straps 226 are attached at the front side of upper portion 222 of inner part 220 by overlapping corresponding buttons 227. In this manner, the straps are releasable to allow a wearer to put garment 100 on in the superior direction and to remove garment 100 in the inferior direction.

In further contrast to inner part 120 of garment 100, inner part 220 of garment 200 may include lower portion 232 that may have central section 236 that divides extending leg portions 234, 238 to form a pattern in the form of shorts. Like central section 136 of garment 100, central section 236 may extend around the groin of a wearer to prevent upward movement of garment 200. As further shown, top edge 228 and opposing bottom edge 229, may be hemmed or folded over and attached to themselves, such as by stitching or by use of an adhesive or other process known in the art, to form even edges.

Outer part 260 of garment 200, in contrast to outer part 160 of garment 100, may be a shortened skirt extending from interface region 250 a distance just beyond lower portion 232 of garment 200. Such an arrangement of the garment may be worn with shorter outer garments, such as shorts or skirts, or may be an outer garment which may be, but is not limited to being, used as activewear for working out or casual lounging. As can be seen in FIGS. 2A and 2B, outer part 260 may include front section 262 and opposing rear section 264 that may extend further in the inferior direction than front section 262. In some arrangements, as shown, outer part 260 may be pleated.

Figure 3:
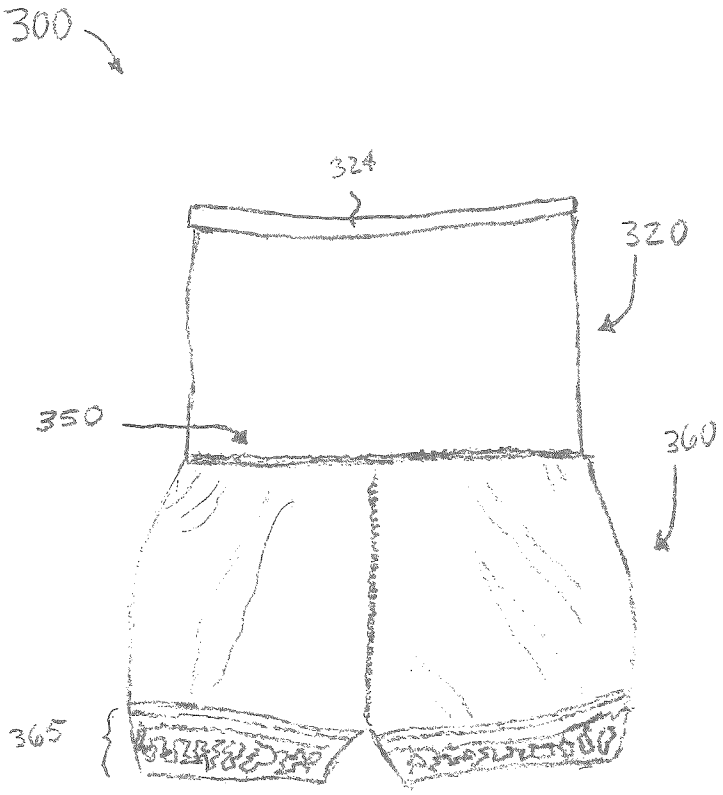
FIG. 3 is a front view of a garment in accordance with another embodiment.

Referring now to FIG. 3, in another alternative arrangement, garment 300 may include upper part 320 that may be attached to lower part 360 at interface region 350. As shown, a majority of garment 300 may be substantially similar to garment 100 with certain notable exceptions. In particular, upper part 320 may be the same as upper portion 122 of garment 100 with the exception that an entire length of upper part 320 may extend in the superior direction from interface region 350 to a location adjacent to or beneath the bust of a wearer. In this manner, upper part 320 may not include a lower portion, such as lower portion 132 of garment 100.

As further shown, lower part 360 may be substantially similar to outer part 160 of garment 100 with the exception that lower part 360 may be, but is not limited to being in the form of pettipants as in the example shown, shorts, which may be substantially similar to lower portion 232, or panties, which may be substantially similar to lower portion 132. Similarly to outer part 160 of garment 100, lower part 360 may have a smooth outer surface that may provide less friction against outer garments as compared to direct contact between such outer garments and other undergarments or a wearer's skin.

Garment 300 may include aesthetic features on the superior and inferior ends thereof. For example, as shown in the example of FIG. 3, garment 300 may include lower edge 365, which may include a sewn-in lace region substantially similar to the sewn-in lace region along the inferior end of lower part 360. Along the superior end of upper part 320, garment 300 may include a border 324 that may be substantially similar to the border 124 of garment 100.

In some alternative arrangements, the garment, including variations of the arrangements of the garment set forth in the disclosure herein, may include various compressive sections any of around, adjacent to, or on the belly of a wearer. In some such arrangements, these compressive sections may be arranged as in any of the examples shown or described in U.S. Patent Application Publication No. 2009/0270012 A1, now U.S. Pat. No. 8,235,766; U.S. Patent Application Publication No. 2012/0302133 A1 ("the '133 Publication"), now U.S. Pat. No. 8,864,551; and co-pending U.S. patent application Ser. No. 14/518,709, the disclosures of all of which are incorporated by reference herein. For instance, the garment may have any of a belly panel providing a low-to-medium compression greater than areas of the garment surrounding the belly panel, a bottom panel below the belly panel made of a medium-to-high compression for supporting a growing belly, side panels located laterally from at least one of the belly panel and the bottom panel, and a hip band forming a section extending from underneath the belly down to and across the hip area. Such a configuration may be especially useful for expectant mothers.

In some alternative arrangements of the garment including variations of any of the arrangements of the garment set forth in the disclosure herein, at least one of the inner part and the outer part or at least one of the upper part and the lower part depending on the arrangement may be made to be seamless or mostly seamless, such as by knitting or weaving strands of fabric to form a continuous structure. In some such arrangements, the continuous structure may include areas, i.e., zones, having different densities of fabric and thus varying degrees of compression. In some arrangements, the inner part or the upper part depending on the arrangement may include seams at either or both of the inferior and superior ends thereof. In some such arrangements, these seams may be, but are not limited to being, used to form a hem or other aesthetic trim or to attach aesthetic trim, such as lace, along at least a portion of a length of the inferior and superior ends.

In some alternative arrangements including variations of any of the arrangements of the garment set forth in the disclosure herein, either or both of the inner part and the outer part may be seamless, mostly seamless as shown, or at least partially seamless. When partially seamless, inner part 120 preferably may be seamless at least 12 mm, or more preferably at least 50 mm, or even more preferably at least 75 mm at least one of above and below the waistline. In a seamless configuration, or in a mostly seamless configuration as shown, inner part 120 may be made of a knitted fabric or other stretchable material. In this manner, inner part 120 may be form-fitted to the body of a wearer and accordingly exert compression against the body of the wearer to allow inner part 120 to remain at substantially the same location on the body of the wearer during use.

In some alternative arrangements of the garment including variations of any of the arrangements of the garment set forth in the disclosure herein, either or both of the inner part and the outer part or either or both of the upper part and the lower part depending on the arrangement may include openings. Such openings may be relatively small and defined by mesh material that may be used to make the garment breathable to reduce perspiration of the wearer. Other such openings may be larger to add stylistic accents to the garment or to reduce compression in various areas of the garment. For example, a large opening may be defined by the inner part or the upper part depending on the arrangement around the circumference or surface of the belly of a wearer. As another example, a large opening may be defined by the inner part around the shoulder blades or spinal area of the wearer, i.e., in a "backless" configuration as known to those skilled in the art. As a still further example, such openings may be defined by cross-shaped areas defined by portions, such as the straps, of the inner part or the upper part depending on the arrangement being in an X-configuration, as more fully described in the '133 Publication incorporated by reference herein.

In some alternative arrangements of the garment including variations of any of the arrangements of the garment set forth in the disclosure herein, the lower portion of the inner part or the lower part depending on the arrangement may be in the form of panties, shorts, or pettipants, as disclosed previously herein, and also may be, but are not limited to being, in the form of a thong, girl shorts, boy shorts, long shorts, legs or leggings, or culottes. The upper and lower portions of the inner part or the upper part and the lower part depending on the arrangement may be attached by a seamed or a seamless connection at an interface region, although a seamless connection may be preferable to reduce the potential for bulging where the upper and lower portions or the upper part and the lower part depending on the arrangement interface.

In some alternative arrangements of the garment including variations of any of the arrangements of the garment set forth in the disclosure herein, the garment may be an outer garment which may be, but is not limited to being, used as activewear for working out or casual lounging. For example, the garment may be a skort or a skirt used for tennis, running, golf, or other activities or simply for lounging. In such arrangements as well as in some instances when used as an undergarment, the garment may be made, but are not limited to being made of polyester/spandex blends or nylon/spandex blends that may exhibit better moisture-wicking and performance stretch characteristics relative to other materials such as cotton.

In some such alternative arrangements including variations of any of the arrangements of the garment set forth in the disclosure herein, the interface region between the upper and lower portions of the inner part or between the upper part and the lower part, depending on the arrangement, may be a seamless connection at least 12 mm, or more preferably at least 50 mm, or even more preferably at least 75 mm at least one of above and below the waistline. In such a configuration, at least the interface region may be made of a knitted fabric or other stretchable material. In this manner, at least the interface region may be form-fitted to the body of a wearer and accordingly exert compression against the body of the wearer to allow the interface region to remain at substantially the same location on the body of the wearer during use.

In some alternative arrangements of the garment including variations of any of the arrangements of the garment set forth in the disclosure herein, straps may be attached to the front and rear sides of the garment and may be extended around a wearer's shoulders as well as between the front and rear sides of the garment. In other arrangements, the straps may be extended around the neck of a wearer and be attached at two or more spaced-apart locations on the front portion by buttons on one or both sides. The straps may be attached by buttons, clasps, hook-and-eye or hook-and-loop configurations in which a hook of one attachment element is curved for attachment by wrapping around an eyelet or loop in which the hook is received, snaps, strings or ties, or any other type of attachment known to those skilled in the art.

In some alternative arrangements of the garment including variations of any of the arrangements of the garment set forth in the disclosure herein, the upper portion of the inner part or the upper part depending on the arrangement may extend from the interface region not only to a position below the bust of a wearer but also to positions on or above the bust of a wearer. In such arrangements, the upper portion of the inner part or the upper part depending on the arrangement may extend over the shoulders of a wearer. In some alternative arrangements of the garment including variations of any of the arrangements of the garment set forth in the disclosure herein, the outer part or the lower part depending on the arrangement may extend a length to cover any portion of a wearer's legs such as, but not limited to, locations adjacent a wearer's ankles, just below a wearer's knee, just above a wearer's knee, and high on the thigh of a wearer.

In any variation of the garment set forth in the disclosure herein, besides knitted or woven fabrics such as tricot and raschel knits, the inner part, and in some such arrangements only the upper portion of the inner part, or the upper part depending on the arrangement may be, but are not limited to being, made of any stretchable or elastic material such as nylon, spandex, elastane, and lycra or other fabric that provides friction against a wearer's body. In preferred arrangements, the inner part, and in some such arrangements only the upper portion of the inner part, or the upper part depending on the arrangement may be made of a material that provides at least one of compression and support for smoothing the shape of the body of a wearer. In some arrangements, either of the inner part or the upper part depending on the arrangement may be compressive such that it may be considered a support band for the garment.

Further, in any variation of the garment set forth in the disclosure herein, to promote flowability of outer garments, the outer part or the lower part depending on the arrangement may be, but are not limited to being, made of smoother or lower friction fabrics such as any of certain knitted fabrics, polyester, cotton, taffeta and other types of silk, tricot, raschel knits, and lace. In this manner, the outer part or the lower part depending on the arrangement may allow for outer garments worn thereon to slide more freely relative to the outer part or the lower part depending on the arrangement. Moreover, such a configuration may provide an anti-static layer between a body of a wearer and outer garments worn thereon. Additionally, in some arrangements, the outer garment may be made of fabrics that make the outer garment transparent or translucent, although in preferred arrangements, the outer garment may be opaque to prevent a silhouette of a portion of a wearer's legs covered by the outer part or the lower part depending on the arrangement from being visible to others.

In some alternative arrangements of the garment including variations of any of the arrangements of the garment set forth in the disclosure herein, either or both of the lower portion of the inner part and the outer part or the lower part depending on the arrangement may be, but are not limited to being, made of any stretchable or elastic material such as nylon, spandex, elastane, and lycra or other fabric that provides friction against a wearer's body. In preferred arrangements, any of the lower portion of the inner part, the outer part, and the lower part depending on the arrangement may be made of a material that provides at least one of compression and support for smoothing the shape of the body of a wearer.

In some alternative arrangements of the garment including variations of any of the arrangements of the garment set forth in the disclosure herein, at least one of the inner part and the outer part or at least one of the upper part and the lower part depending on the arrangement may be, but are not limited to being, knitted, woven, or otherwise formed in a tube-like configuration along a length thereof such that the garment does not have a seam running in at least one of a vertical direction along such length and a horizontal direction transverse to such length. Alternatively, in some alternative arrangements of the garment including variations of any of the arrangements of the garment set forth in the disclosure herein, at least a portion of at least one of the inner part and the outer part or at least one of the upper part and the lower part depending on the arrangement may be formed by, but are not limited to being, woven, knitted, or otherwise formed panels of fabric that are sewn, stitched, or otherwise attached together.

In some alternative arrangements of the garment including variations of any of the arrangements of the garment set forth in the disclosure herein, at least one of the inner part and the outer part or at least one of the upper part and the lower part depending on the arrangement may include padding inserted or otherwise attached thereto to provide additional shaping to a wearer's body. Such padding may be in the form of butt enhancers as known to those skilled in the art. In some alternative arrangements, at least one of the inner part and the outer part or at least one of the upper part and the lower part depending on the arrangement may include large openings. Some such openings may be used to lift the buttocks as known to those skilled in the art.

In some arrangements, the outer part or the lower part in any variation of the garment that is the subject of this disclosure may be attached to the respective inner part or the upper part depending on the arrangement at various locations including, but not limited to, above, at, and below the waistline of the wearer. In some arrangements, the outer part or the lower part of the garment depending on the arrangement may define an A-line design as known to those of skill in the art. In some arrangements, the outer part or the lower part depending on the arrangement may include various accents such as, but not limited to, pleats and ruching at various locations including around a portion or around an entire circumference thereof.

In some alternative arrangements of the garment including variations of any of the arrangements of the garment set forth in the disclosure herein, the outer part or the lower part may be inseparably affixed to the respective inner part or the upper part depending on the arrangement by various bonding agents such as, but not limited to, glue, epoxy, or other chemical bonding agent. In some other alternative arrangements, the outer part or the lower part may be removably affixed to the respective inner part or the lower part depending on the arrangement by various elements such as, but not limited to, any of one or more releasable ties or strings, one or more buttons, one or more fabric hook and loop fasteners such as VELCRO fasteners, and one or more zippers.

In any variation of the garment set forth in the disclosure herein, various types of stitching may be used to any of attach the outer part to the inner part or the upper part to the lower part depending on the arrangement, to attach any portions of the inner or outer parts to other portions of the respective inner and outer parts, and to attach any portions of the upper or lower parts to other portions of the respective upper and lower parts. Such stitches may be, but are not limited to being, straight stitches, zigzag stitches, and overlock stitches. It is to be understood that such stitches may be interchanged at various locations on the garment as known to those skilled in the art depending on the desired look and strength-needs of the garment.

It is to be understood that the disclosure set forth herein includes all possible combinations of the particular features set forth above, whether specifically disclosed herein or not. For example, where a particular feature is disclosed in the context of a particular aspect, arrangement, configuration, or embodiment, or a particular claim, that feature can also be used, to the extent possible, in combination with and/or in the context of other particular aspects, arrangements, configurations, and embodiments of the technology, and in the technology generally.

Furthermore, although the technology disclosed herein has been described with reference to particular features, it is to be understood that these features are merely illustrative of the principles and applications of the present disclosure. It is therefore to be understood that numerous modifications, including changes in the sizes of the various features described herein, may be made to the illustrative embodiments and that other arrangements may be devised without departing from the spirit and scope of the present disclosure. In this regard, the present disclosure encompasses numerous additional features in addition to those specific features set forth in the claims below. Moreover, the foregoing disclosure should be taken by way of illustration rather than by way of limitation as the present technology is defined by the claims set forth below.

The invention claimed is:

1. A garment comprising:

a seam;

an inner part having an upper portion for covering and compressing at least a portion of a mid-section of a wearer above a waistline of a wearer and a lower portion attached at a seam to the upper portion for covering a groin of a wearer to limit movement of the inner part in a superior direction, the seam being configured to be at a waistline of a wearer; and an outer part attached to the inner part at the seam where the upper portion attaches to the lower portion and overlapping the lower portion thereof.

2. The garment of claim 1, wherein the lower portion of the inner part is in the form of panties or a thong.

3. The garment of claim 1, wherein the lower portion of the inner part is in the form of shorts.

4. The garment of claim 1, wherein the lower portion of the inner part is in the form of pettipants.

5. The garment of claim 1, wherein the outer part is pleated.

6. The garment of claim 1, wherein the upper and lower portions of the inner part are defined within a single piece of material such that there is a visibly seamless transition therebetween at least 12 mm above, below, or both above and below the waistline.

7. The garment of claim 1, wherein the upper and lower portions of the inner part are sewn together to form a seam.

8. The garment of claim 1, wherein the outer part is attached to the inner part at the waistline of the wearer.

9. The garment of claim 1, wherein an entire length of the inner part extends in a superior direction to an upper peripheral edge, the upper peripheral edge being positionable beneath and adjacent to the bust of the wearer.

10. The garment of claim 1, wherein the inner part is arranged to cover the bust of the wearer.

11. The garment of claim 1, further comprising at least one strap attachable to front and back portions of the inner part and extendable over a wearer's shoulders and between the front and back portions or extendable around the neck of the wearer and attachable at spaced-apart locations on the front portion.

12. The garment of claim 1, wherein an uppermost portion of the outer part is attached to the inner part where the upper portion of the inner part attaches to the lower portion of the inner part such that the upper portion of the inner part is uncovered by the outer part.

13. The garment of claim 1, wherein the garment includes a top edge having a folded over portion of the garment stitched to another portion of the garment.

* * * * *